United States Patent [19]

Danna

[11] 3,992,757

[45] Nov. 23, 1976

[54] ADJUSTABLE SIDE OPENING WATCHBAND BUCKLE

[75] Inventor: Louis J. Danna, Palisades Park, N.J.

[73] Assignee: Kreisler Manufacturing Corporation, St. Petersburg, Fla.

[22] Filed: Jan. 9, 1975

[21] Appl. No.: 539,640

[52] U.S. Cl. ..... 24/77 R; 24/206 R; 24/201 HE

[51] Int. Cl.[2] ..... A44B 11/28

[58] Field of Search..... 24/77 R, 206 R, 201 HE, 24/241 WB, 265 BC, 265 BH, 265 WS, 172, 173, 73 BH, 73 BB, 210

[56] References Cited

UNITED STATES PATENTS

| | | | |
|---|---|---|---|
| 150,239 | 4/1874 | Heiles | 24/210 |
| 317,873 | 5/1885 | Spooner | 24/77 R |
| 394,013 | 12/1888 | Rubin | 24/210 |
| 508,752 | 11/1893 | Prahar | 24/210 |
| 1,003,907 | 9/1911 | Hoffman | 24/206 R |
| 1,202,271 | 10/1916 | Depollier | 24/265 WS |
| 1,557,624 | 10/1925 | Starmer | 24/77 R |
| 1,792,304 | 2/1931 | Hood | 24/206 R |
| 2,495,667 | 1/1950 | Vizner | 24/206 R |
| 2,568,845 | 9/1951 | Carroll | 24/230 A |
| 2,861,626 | 11/1958 | Mills | 24/206 R |
| 3,319,308 | 5/1967 | Williams | 24/206 R |
| 3,339,248 | 9/1967 | Campaiola | 24/206 B |

FOREIGN PATENTS OR APPLICATIONS

| | | | |
|---|---|---|---|
| 1,336,780 | 7/1963 | France | 24/206 R |
| 406,710 | 8/1966 | Switzerland | 24/206 R |
| 638,795 | 6/1950 | United Kingdom | 24/77 R |

*Primary Examiner*—Bernard A. Gelak
*Attorney, Agent, or Firm*—Shenier & O'Connor

[57] ABSTRACT

An adjustable side opening buckle for securing the tongue end of a watchband or the like to the buckle end of the band in which a frame forms a generally rectangular passage for receiving the buckle end of the band with a spring plate biased between the top of the frame and the upper surface of the band to urge one of a plurality of spaced notches in the underside of the band into engagement with a boss on the bottom of the frame adjustably to hold the buckle end in position on the frame and in which upwardly extending hooks spaced along the top of the frame are adapted to be received in slots in a tongue plate secured to the tongue end of the band and in which a cover supported on the frame for pivotal movement on an axis extending along one side of the frame is adapted to be moved from an open position to a closed position over the frame in which closed position it snaps into engagement with the frame to retain the tongue plate in engagement with the frame hooks.

10 Claims, 4 Drawing Figures

Fig 2
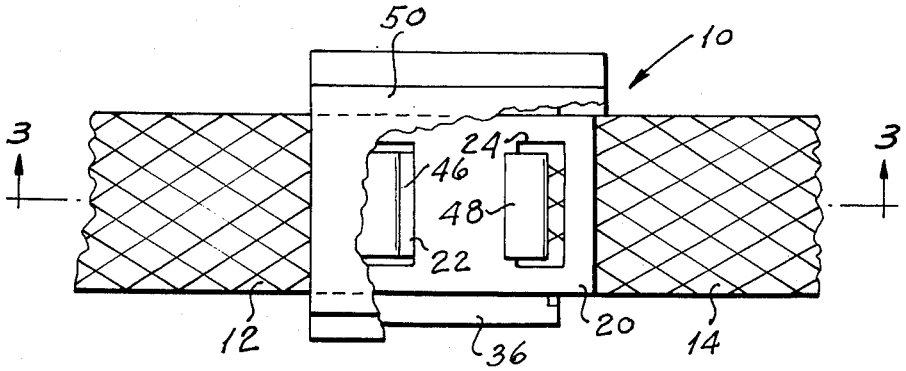
Fig 3
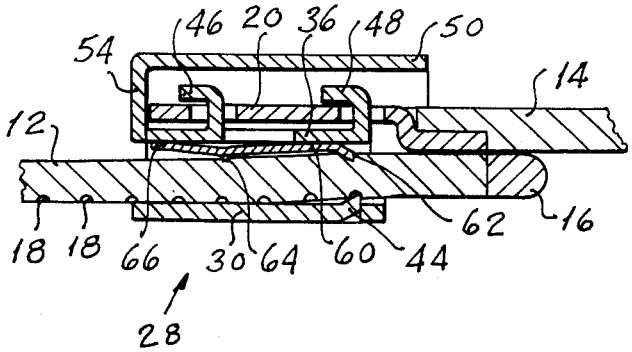
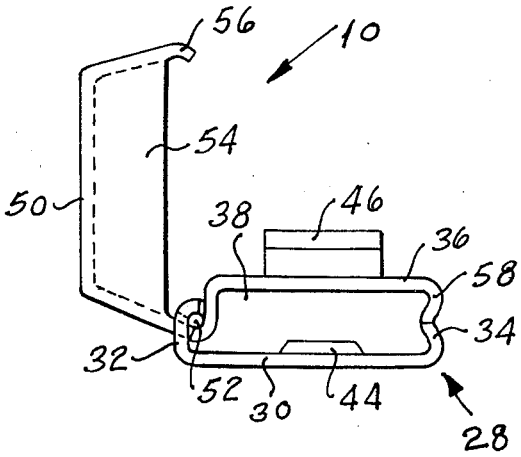
Fig 4

ADJUSTABLE SIDE OPENING WATCHBAND BUCKLE

BACKGROUND OF THE INVENTION

This invention relates to an improved buckle for securing the ends of a watch or jewelry band made of metal mesh or some similar inelastic, semiflexible material.

There are a number of watchband buckles known in the prior art which are securely fastened to one end of the watchband, while being provided with a channel having a boss or ridge adapted to engage one of a number of notches located on the underside of the buckle end of the band, according to the length desired. A cam or similar device coupled to the buckle cover is used to urge the buckle end into contact with the boss located in the channel. One such device is disclosed in U.S. Pat. No. 3,735,455, issued to S. Hauser, and entitled "Slip-Through Buckle." While such buckles have proven successful, they share certain drawbacks. The requirement that such buckles be easy to work is at odds with the requirement that such buckles provide positive locking action. If, for example, the boss in the buckle channel is misaligned with the desired notch, as may easily happen, the buckle may suddenly break open and possibly cause damage to the watch. Moreover, the cam or similar means which urges the tongue end into contact with the boss is susceptible to fatigue or other failure. Further, the provision of a cover in such buckles which opens in the direction of the band usually requires a hinge mounted transversely and above the tongue end, thereby adding to the overall height of the buckle.

SUMMARY OF THE INVENTION

One object of my invention is to provide a watchband buckle which provides positive fastening means.

A second object of my invention is to provide a watchband buckle which is less susceptible to fatigue or other failure than are buckles of the prior art.

A third object of my invention is to provide a watchband buckle which is compact.

A fourth object of my invention is to provide a watchband buckle which is simpler to operate than are watchband buckles of the slip-through type known in the prior art.

Other and further objects of my invention will appear from the following description:

In general, my invention contemplates a buckle for securing a band of a watch or other item of jewelry having a tongue end and a buckle end, the buckle comprising a frame forming a generally rectangular channel adapted to receive the buckle end, having a pair of hooks mounted above said channel adapted to engage holes provided in a tongue plate terminating the tongue end, and having a cover pivotally mounted to the side of the frame and adapted to close over the hooks, locking in the tongue plate. The buckle end, which is provided with a number of spaced notches on its underside, is secured to the frame by inserting it in the channel until a desired notch engages a boss provided on the lower channel surface. A spring plate inserted into the channel between the band and the upper channel surface urges the band against the lower surface of the channel.

The wearer or the retail dealer secures the buckle end to the buckle once when the watch is acquired, selecting the notch to match the wrist size. The band is thereafter fastened or unfastened by securing the tongue plate or removing it from the pair of hooks provided on the buckle frame. The hooks provide a positive and sure fastening action not found in buckles whose normal fastening means employs a boss. While the boss and notches employed in the one-time fastening means share several features found in existing buckles, the securing action is more positive since greater locking pressure may be used than in buckles where such means must provide the normal fastening means as well as the means for adjustment. Also, the fact that the one-time fastening means is used only once in the initial adjustment lessens the possibility of band uncouplings caused by misalignment.

BRIEF DESCRIPTION OF THE DRAWINGS

In the accompanying drawings which form part of the instant specification and which are to be read in conjunction therewith and in which like reference numerals are used to indicate like parts in the various views:

FIG. 2 is a fragmentary top plan view of a watchband provided with my buckle with parts broken away and showing the watchband ends secured.

FIG. 3 is a sectional view of the structure shown in FIG. 2, taken along lines 3—3 thereof.

FIG. 4 is an end elevation view of my buckle with the cover in an open position.

DETAILED DESCRIPTION OF THE PREFERRED EMBODIMENT

Figure 1:
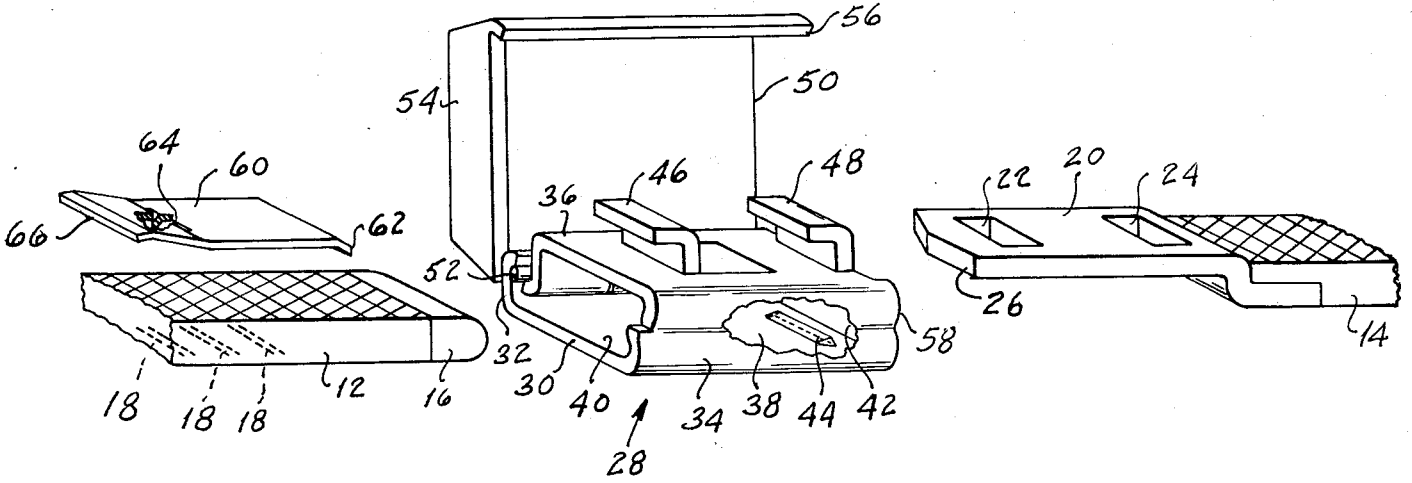
FIG. 1 is an exploded perspective view of my buckle and accompanying watchband ends, showing the buckle and accompanying parts in positions to be secured.

Referring now to the drawings, the buckle, indicated generally by the reference numeral 10, which is used to secure a watchband formed of mesh or links of metal or some similar inelastic, semiflexible material has a buckle end 12 and a tongue end 14. The buckle end 12 is provided with a metal cap 16 at its tip and is provided with a plurality of recesses or notches 18 spaced along its underside. The tongue end 14 of the watchband is spot welded or otherwise secured to a metal tongue plate 20 having a pair of holes 22 and 24 disposed at spaced locations along the length thereof. Holes 22 and 24 are adapted to receive a pair of hooks provided on the tongue plate 20 and to be described. The inner portion 26 of the end of the tongue plate 20 is angled for a purpose to be described.

Referring now to the buckle indicated generally by the reference character 10, a metal frame 28 has a base 30, sides 32 and 34 and a top 36 disposed above and substantially parallel with the base 30. The base 30 and the top 36 form a channel 38 having a fore opening 40 and a rear opening 42 and adapted to receive the buckle end 12 of the band through the fore opening 40. The base 30 is provided near the rear opening 42 with a boss 44 which is adapted to engage one of the notches 18 of the buckle end 12. We form top 36 with a pair of hooks 46 and 48 of inverted L-shape extending up from and towards the fore end of the top 36, on the pressure plate 36 at spaced locations therealong. Hooks 46 and 48 are adapted to engage the holes 22 and 24 of the tongue plate 20 respectively. Preferably the hooks 46 and 48 are stamped out of the same piece used to form the frame 28.

We pivotally mount a cover 50 on the frame 28 by means of a pin 52 which is received along one side of the frame 28. The cover 50 has a fore end 54 extending down to the level of the pressure plate 36 and is open at its rear end. The location of the fore end 54 of the cover 50 with respect to the fore hook 46 is such that, when the cover 50 is closed, the tongue plate 20 is locked in against the hooks 46 and 48. Closing the cover 50 causes the lower edge of the cover end 54 to contact the angled portion 26 of the tongue plate 20 and thus urge it back against the hooks 46 and 48. A lip 56 extending along the free side of the cover 50 receives a complementary ridge 58 formed along the side of the frame 28 releasably to hold the cover in its closed position.

A spring plate 60 is adapted to be inserted in the channel 38 between the buckle end 12 and the pressure plate 36 and to urge the buckle end against the base 30 and the boss 44. The plate 60 has a downturned leading edge 62 adapted to engage the mesh of the buckle end 12. A second edge 64, formed across the inner portion of the plate 60 about two-thirds of the way behind the leading edge 62, extends downward and away from the leading edge 62 and is also adapted to engage the mesh of the buckle end 12. The plate 60 is bent slightly upward behind the second edge 64 and has a trailing edge 66 which is bent slightly downward.

The buckle end 12 is secured to the buckle 10 by inserting it into the fore end 40 of the channel 38 along with the spring plate 60, which is placed against the top of the buckle end 12 with its leading edge 62 turned downward, facing the channel 38 as shown, and positioned over the desired notch 18. The buckle end 12 and the spring plate 60 are inserted into the channel 38 until the spring plate 60 is completely inside the channel 38 and the desired notch 18 engages the boss 44, at which point the pressure of the spring plate 60 prevents further forward motion.

Although the buckle end 12, once having been secured to the buckle end 10, may be retracted simply by pulling it out firmly from the buckle 10, it need not be so undone as long as the wrist size remains the same. When the wearer puts on the watch, the band is fastened by slipping the tongue plate 20 of the tongue end over the matching hooks 46 and 48 and then closing the cover 50, pushing the tongue plate 20 back against the hooks 46 and 48 thus locking it.

It will be seen that I have accomplished the objects of my invention. I have provided a watchband buckle which provides positive fastening means. My buckle is less susceptible to fatigue or other failure. My buckle is compact.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A buckle assembly for securing the buckle end of a band to the tongue end thereof including in combination, a frame forming a passage extending in the direction of the length of said band for receiving the buckle end of said band, means for adjustably securing said buckle end of said band in said passage, interengageable means on said frame and on the tongue end of said band for detachably connecting said tongue end of said band to said frame, a cover, means located at one side of said frame and running along the length thereof mounting said cover on said frame for pivotal movement around an axis generally parallel to the length of said band from an open position at which said interengageable means are accessible to a closed position over said interengageable means to retain said interengageable means in engagement, and means for releasably holding said cover in said closed position.

2. A buckle assembly as in claim 1 in which said means for securing said buckle end of said band in said passage comprises interengageable elements on said buckle end and on said frame and means for retaining said elements in engagement.

3. A buckle assembly as in claim 2 in which said retaining means comprises a resilient plate.

4. A buckle assembly as in claim 3 in which said frame has a top and a bottom, in which said interengageable elements comprise a boss on said bottom and a plurality of spaced boss-receiving recesses in the underside of said band adjacent to the buckle end thereof, and in which said plate is disposed between said band and said frame top.

5. A buckle assembly as in claim 4 including means for inhibiting sliding movement of said plate with respect to said band.

6. A buckle assembly as in claim 5 in which said inhibiting means comprises edge forming portion of said plate adapted to engage the upper surface of said band adjacent to the buckle end thereof.

7. A buckle assembly as in claim 6 in which said edge-forming portion of said plate is a downturned portion at one end of said plate in the direction of the length of said band for inhibiting movement of said plate relative to said band in one direction and in which said plate has a second edge forming portion for inhibiting movement of said plate relative to said band in the other direction.

8. A buckle assembly as in claim 7 in which said interengageable means comprises a hook formed on the top of said frame and means forming an opening in the tongue end of said band for receiving said hook.

9. A buckle assembly as in claim 8 in which said interengageable means comprises a pair of hooks on said frame and means forming a pair of spaced openings at the tongue end of said band for receiving said hooks, said hooks and said openings being spaced in the direction of the length of said band.

10. A buckle assembly as in claim 1 in which said interengageable means comprises a pair of hooks on said frame and means forming a pair of spaced openings at the tongue end of said band for receiving said hooks, said hooks and said openings being spaced in the direction of the length of said band.

* * * * *